United States Patent [19]

Dusenberry

[11] 3,960,550

[45] June 1, 1976

[54] SILVER RECOVERY PROCESS

[76] Inventor: William L. Dusenberry, 7046 E. Paradise Drive, Scottsdale, Ariz. 85218

[22] Filed: Feb. 24, 1975

[21] Appl. No.: 552,411

[52] U.S. Cl. ..... 75/118 P; 75/83; 423/42

[51] Int. Cl.[2] ..... C22B 11/04

[58] Field of Search ..... 75/118 P, 83; 423/42

[56] References Cited

UNITED STATES PATENTS

| | | | |
|---|---|---|---|
| 2,131,045 | 9/1938 | Hickman et al. | 75/83 |
| 2,643,108 | 6/1953 | Lieberman | 266/22 |
| 3,418,237 | 12/1968 | Booth et al. | 210/54 |
| 3,451,788 | 6/1969 | Smith | 23/299 |
| 3,594,157 | 7/1971 | Hendrickson et al. | 75/112 |
| 3,647,422 | 3/1972 | Wainer | 75/101 R |
| 3,660,079 | 5/1972 | Govani | 75/118 P |
| 3,748,123 | 7/1973 | Bakker | 75/97 |

*Primary Examiner*—G. Ozaki

[57] ABSTRACT

The disclosure relates to a method for reclaiming silver from photographic substrates and particularly a method wherein silver halide coated substrates, such as plastic film, is subjected to a bleach solution for removing the silver bearing emulsion from the substrates the emulsion it is then placed in a settling tank and subjected to the use of sodium hydroxide and a flocculating agent, such that the sodium hydroxide acts to precipitate the silver, while the flocculating agent tends to flocculate it. Then removing the silver sludge from the lower strata of the settling tank and placing it in canvas bags to allow liquids to drain from the sludge while the flocculating agent retains the sludge in the bags. The sludge then dries to a substantially mud like consistency and then the silver sludge, of mud like consistency, is placed in an oven and heated, until the moisture thereof is released, and thereby rendering the mud like sludge dry and in a substantially hard cake like form. Then the hard cake like silver material is pulverized and placed in a crucible with a flux on top; the flux consisting of sodium carbonate and boric acid granules. The crucible is then subjected to heat sufficient to melt the silver out of the pulverized cake. Then the molten silver is poured in a first crucible and thereby forms a silver casting which is a primary casting. These primary castings may be then positioned in a second crucible with charcoal on the upper surface thereof, whereupon the primary castings are remelted, and whereupon the charcoal on top of the molten silver absorbs impurities, and then the molten silver is poured into a second casting of high purity.

14 Claims, 9 Drawing Figures

SILVER RECOVERY PROCESS

BACKGROUND OF THE INVENTION

Various processes for reclaiming silver from photographic substrates have been used, and some of them have involved complicated and expensive equipment such as centrifuges for the purpose of separating silver from liquids in which the silver is precipitated, after being removed from the photographic substrate materials such as plastic film or the like. Centrifuges are expensive and require careful attention as well as proper maintenance.

Additionally, in the smelting of precipitates, gathered from the washing of silver from photographic substrates, various fluxes have been used such as sodium carbonate or soda ash and borax. With such prior art fluxes high alkalinity destroys the crucibles and in this fashion the prior art methods for smelting of the reclaimed silver materials have been relatively costly.

SUMMARY OF THE INVENTION

The present invention comprises a novel method for reclaiming silver from photographic substrates and particularly from pliable plastic substrates such as X-ray film or the like.

The method of the invention comprises the washing of X-ray films or other similar photographic substrates, with silver halides thereon, in a dilute solution of sodium hypochlorite until the silver bearing emulsion is removed from the substrates so that the silver is contained in solution. The solution may then be placed in a settling tank with sodium hydroxide to precipitate the silver and wherein a flocculating agent is also added to flocculate the particles of silver such that the silver in the settling tank forms into a thick sludge in the lower strata thereof. The liquid from the upper levels of the settling tank is then removed leaving the thick sludge in the bottom thereof. The sludge is then transferred to canvas bags and hung such that liquid may drain from the canvas bags while the flocculating agent retains the silver halide in the bag and thereby lets the liquid drain therefrom. The draining operation is continued until such time as the silver sludge in the bag, is in a partially dry mud like consistency, whereupon the silver sludge of mud like consistency is placed in a container and introduced into an oven or furnace in which the sludge, is heated to remove moisture therefrom, and until the sludge is dried into a hard cake like consistency. The silver in this form is then pulverized and placed in a crucible with a flux thereon, said flux consisting of sodium carbonate and boric acid granules. The pulverized silver material is then heated until silver melts, with the flux on top, whereupon the molten silver is poured into a mold and allowed to cool. The flux is then subsequently broken off the silver casting.

The casting, so formed is termed a primary casting which may again be melted with charcoal on the top of the molten mass in a crucible so as to absorb impurities, and whereupon the second melt of the silver may be poured into a second mold to form a final casting of high purity, after the charcoal has absorbed impurities therefrom.

The present invention, employing the drying of silver sludge in canvas bags, provides a very simple and economical means whereby liquid is removed from the silver sludge without the need for expensive equipment such as a vacuum filter press, a manual filter press or a centrifuge and high salaried employees. The use of the canvas bags thus saves a considerable amount of money in the reclaiming of the silver from a liquid solution in which the silver halide has been washed from the photographic substrates. The use of the canvas bags together with a flocculating agent, in the sludge, permits the silver halide sludge to be placed in the canvas bags. The flocculating agent prevents the sludge from leaking out through the mesh of the bags and permits liquids to drain from the bags such as to retain the silver sludge in a substantially mud like consistency, after the bags have been hung a substantial amount of time. The silver in said mud like consistency may then be placed in containers in an oven, or the like, for rapid drying to a dry cake like form. The silver cake is then subjected to pulverization for the subsequent smelting operations to be performed thereon.

Accordingly, it is an object of the present invention to provide a method, for reclaiming silver from photographic substrates, which employs very simple and economical equipment and economical labor.

Another object of the invention is to provide a method for reclaiming silver from pliable photographic substrates wherein fabric bags are used for separating silver sludge from the liquids in which they are washed from the photographic substrates.

Another object of the invention is to provide a method, for reclaiming silver from photographic substrates, which is particularly adapted for use in removing silver halides from various pliable photographic substrates such as X-ray film or the like.

Another object of the invention is to provide a method, for reclaiming silver from photographic substrates, which is economical with respect to the use of materials.

Another object of the invention is to provide a method for reclaiming silver from photographic substrates, wherein novel foundry practice is utilized employing a special flux which greatly extends the life of crucibles in which the pulverized silver cake material is melted.

Another object of the invention is to provide a method for reclaiming silver from photographic substrates, in which novel foundry practice comprises a novel silver metal refining process in which first and second melts are covered with appropriate fluxes to remove substantially all the impurities from silver at the time the second melt and casting is made.

Another object of the invention is to provide a novel method, for reclaiming silver from pliable photographic substrates, wherein a tumbler is used to tumble and separate the thin plastic photographic substrates from each other, before a washing solution of sodium hypochlorite material is introduced into the rotary drum washer, so that the thin plastic photographic substrates are first separated before the washing liquid is introduced into contact therewith.

Further objects and advantages of the present invention may be obvious from the following specification, appended claims and accompanying drawings.

DESCRIPTION OF THE PREFERRED EMBODIMENTS

The present invention relates to a method for reclaiming silver from photographic substrates and particularly from pliable plastic substrates such as plastic film or the like. These plastic photographic substrates are common to X-ray films, and due to the great volume of such X-ray pictures or films, a substantial amount of silver may be reclaimed from the photographic films after they have served their useful purpose.

Figure 1:
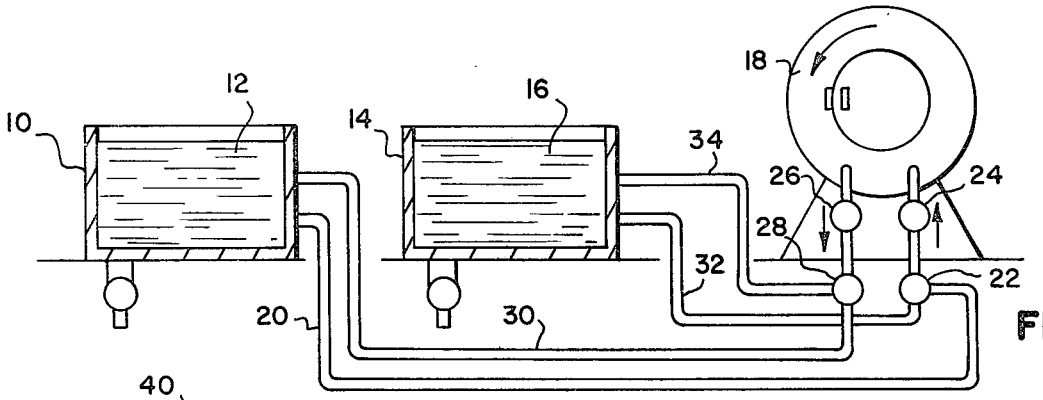
FIG. 1 is a diagrammatic view of the photographic substrate tumbling and washing apparatus used in carrying out the method of the invention.

Reference is made to FIG. 1 of the drawings which shows the basic washing equipment and tumbling equipment used in the initial steps taken in processing photographic substrates for reclaiming silver therefrom.

In FIG. 1 a tank 10 is preferably a large fiberglass tank adapted for use in holding a mixture or solution of sodium hypochlorite. The solution as for example may contain 50 gallons of water in which a bleach solution is introduced, and the bleach solution by weight is a 14% solution of sodium hypochlorite; and the ratio between the water and the bleach solution is 1 part of bleach solution to each 10 parts of water.

Thus the tank 10 may contain a dilute solution of sodium hypochlorite designated 12 and a second tank 14 is filled with rinse water 16. These tanks 10 and 14 communicate with a rotary washing machine 18 similar to a rotary clothes washing machine. This machine 18 is provided with a rotating drum inside which is adapted to tumble the photographic substrates being processed.

A tubular conductor 20 communicates with the interior of the tank 10 and is adapted to transfer the solution from the tank 10 through a two-way valve 22 via a pump 24 into the rotary washing machine 18. Accordingly, the process comprises the use of the dilute solution of sodium hypochlorite in the washing machine 18 as will be hereinafter described.

The first step of the method comprises the placement of the pliable photographic substrates bearing silver halide in the rotary washing machine 18 without any fluid therein so that the sheets may be tumbled in dry condition and thereby the sheets are agitated and separated so that they do not cling together in face to face relationship to each other and will thus be open to the processing solution when introduced through the conduit 20, valve 22 and pump 24.

When the sheets have been properly tumbled and separated, the solution 12 from the tank 10 is introduced through the valve 22, via the pump 24, and the photographic substrates are tumbled and washed until the silver bearing emulsion or silver halide is removed from the substrates and is carried in the solution of sodium hypochlorite. The average washing cycle is approximately 4 minutes, whereupon the solution is removed from the rotary washer 18, by a pump 26 via a valve 28, and returned through a conduit 30 to the interior of the tank 10. Thus the silver halides are carried in the solution into the tank 10 and subsequently rinse water is pumped through a conduit 32 and the valve 22, via the pump 24, into the rotary washer 18 which is then operated for approximately 2 minutes or more to rinse the film. The pump 26 is again activated with the valve 28 in another position so that the rinse water is returned through the valve 28, via a return tube or conduit 34, and back into the rinse water tank 16.

It will be understood that the rinse water 16 gradually accumulates some of the silver halide; however, the major portion thereof is carried back into the tank 10 in the sodium hypochlorite solution.

Washing time of the film in the rotary washer 18 may be judged by the condition of the film after it is rinsed. If the film, when removed from the washer, appears to be quite heavily coated with a whitish residue that is quite loose on the base film, this is indicative of the fact that sufficient time has not been given for rinsing. Accordingly, the rinsing time should be increased for the next batch of film processed through the rotary washer 18.

The solution 12 in the tank 10 is used repeatedly in the rotary washer 18 until the solution no longer efficiently removes the silver halide from the film. Then it is necessary to add approximately 4 gallons of the aforementioned bleach, namely, the dilute solution of sodium hypochlorite into the washer 18; and then more water may be added, after the washer is closed, to accomplish a level which represents about ⅓ of the full washer capacity so as to provide for a proper volume of washing solution for that particular load of film.

It is desirable to add the bleach solution to the wash water, each time the wash water is used in the rotary washer 18, since it is desirable to keep the temperature of the solution down to a range between 60° and 65° Fahrenheit so as to save time in the adding of the bleach due to exothermal reactions which may take place.

Figure 2:
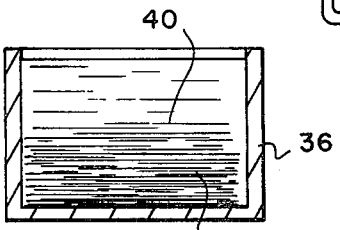
FIG. 2 is a sectional view of a settling tank used in the method of the invention.

After the solution 12, in the tank 10, has been used several times and it ceases to wash the film properly, it is drained into a settling tank such as shown in FIG. 2 of the drawings or it may be drained into several settling drums. When the wash water reaches a condition where it ceases to wash the film, the addition of more bleach solution only raises the pH higher and higher and causes the bleach to vaporize out of the solution regardless of the temperature. Therefore, the solution 12, in the tank 10, finally reaches a somewhat saturated condition of the silver halide.

Initially and each time the film is washed, the bleach when contacting the film, creates an exothermal reaction at the surface of the film, thereby heating the surface and converting the bleach water at the film surface into sodium hydroxide. The sodium hydroxide NaOH loosens the emulsion from the film, and the washing action thus invests the emulsion into the water whereby, sodium, hydrogen and sodium hypochlorite react with the oxygen in the water to form sodium hydroxide. This is the reaction which causes the water to raise the pH of the wash water.

After the wash water containing the bleach no longer washes the film this water is pumped into settling drums or is allowed to set until the silver solution is in the form of a sludge on the bottom of the tank 10, or the tank 14 may be removed as will be hereinafter described.

After the silver containing solution has been placed in the settling tank 36, approximately ¾ of a gallon of sodium hydroxide and approximately the same amount of Separan is added to the solution in the tank 36 while stirring the solution.

Separan is a flocculating agent and sold under the trademark "Separan" by Van Waters and Rogers at 50 South 45th Avenue, Phoenix, Arizona. This flocculating agent together with the sodium hydroxide is used to flocculate the particles of silver halide and the sodium hydroxide is used to precipitate the silver halide into the bottom of the tank 36. The aforementioned sludge, being designated 38, and being below a level 40 in the tank 36 when completely settled for a period of 12 to 24 hours.

Settling of the silver halide into the sludge area 38 is accomplished by the sodium hydroxide introduced therein. This chemical has an extremely high pH factor and when placed in the settling tank 36 it raises the pH factor from approximately 6 or 7 to about 9 or more whereupon precipitation of the silver halide are assured, and thus they settle into the sludge area 38. The sodium hydroxide water is prepared by stirring the sodium hydroxide into water, the ratio being 40 gallons of water to 15 pounds of sodium hydroxide and this material is stirred constantly in solution. The Separan solution is made by utilizing 40 to 45 gallons of water and adding roughly 388 grams of Separan granules and this also requires a considerable amount of stirring as required to bring the materials into solution. Of the two solutions, namely, the sodium hydroxide and the Separan solutions, about ¾ of a gallon of each is introduced into each settling tank 36 which may be a conventional oil drum or the like. The Separan causes the tiny silver particles to clump together and flocculate forming larger masses, which fall to the bottom of the tanks leaving the liquid above without any silver in it. As shown in FIG. 2, precipitation together with flocculation, collects the silver into a sludge 38 below the line 40 in the settling tank 36 and the liquid above the line 40 is drained off preferably after the settling function has been allowed to take place for at least 24 hours. Following this the liquid, above the sludge area 40, is pumped back into the wash tank 10 leaving the silver bearing sludge 38 in the lower strata areas of the settling tanks or drums 36 of which there may be several.

After the liquid has been drained from above the line 40 which is a demarcation between the upper and lower stratas, the sludge is placed in canvas bags 40 and held closed at their upper ends 42. These bags 40 are suspended from a bar 44 and the specific structure of the bags may be defined as No. 30 canvas duck comparable to artists' canvas. This fabric of the bags 40 together with the flocculating agent causes the surface sludge to be retained in the bags while liquid drains therefrom onto an inclined surface 46 and then into a trough 48 later to be pumped back to the tank 10.

Figure 3:
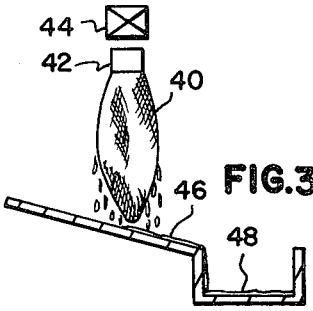
FIG. 3 is a view of canvas bags and a drain trough in which silver halide sludge is contained in the bags, together with a flocculating agent for allowing the liquids to be drained therefrom.

As shown in FIG. 3 the sludge 38 is placed in the canvas bags, to remove the excess liquid from the sludge, the Separan acts to permit the clear liquid to seep through the canvas bags, but due to its flocculating action retains the silver sludge inside of the bags. In the initial filling of the canvas bags with the sludge some of the silver will leak through until the Separan starts to act. At this time this silver is caught and drained into another tank for refilling the bags at a later time with it. After the sludge has been placed into the bags the liquid drains on an inclined plane 46 and into a trough 48 and this liquid is then returned to the tank 10.

Figure 5:
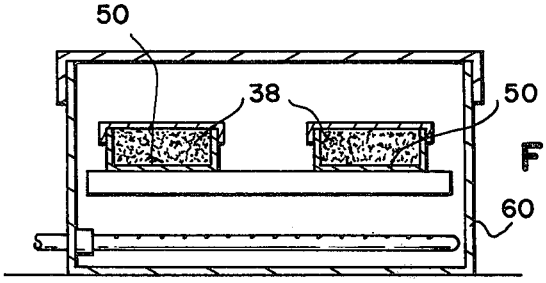
FIG. 5 is a sectional view of an oven in which the pulverized silver halide materials are processed in accordance with the present invention.

After the sludge 38 in the bags 40 has drained and partially dried, the sludge attains a mud like or modeling clay consistency whereupon it is removed from the bags 40 and placed in Corningware containers 50. These containers 50 are placed in a furnace 60 as shown in FIG. 5 of the drawings wherein the sludge 38 is dried to a hard cake like consistency in the containers 50.

During the baking process in the oven 60 and after the moisture has been almost completely removed, other chemicals, due to their high vaporization point would be removed at a certain temperature and length of time. Vaporization of the bake out process will then have been completed. Almost at the end of this bake out time a large quantity of smoke and fumes will be released which will notify the operator that the bake out time is coming to a close. This baking out of the sludge accomplishes several things. First of all it removes the moisture thereby determining a more accurate weight of the dried sludge or cake, and most important of all removes many elements and chemical combinations that would affect the purity of the metal in the primary melt of the cake as will be hereinafter described.

Improper bake out of the sludge can cause innumerable problems in the smelting process and great attention should be paid to see that this bake out is properly accomplished. The temperature at which the sludge 38 may be baked, in the containers 50, should be approximately 600 degrees Fahrenheit and this temperature should be applied to the sludge 38 for approximately 8 hours.

Figure 4:
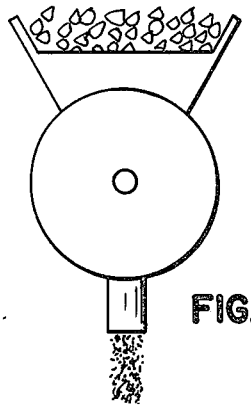
FIG. 4 is a view of a pulverizing mill used with the method of the invention.
Figure 6:
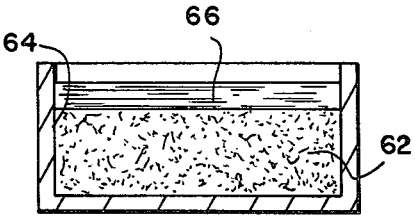
FIG. 6 is a sectional view of a first crucible in which pulverized silver halides are first melted.

Following the baking process in the oven 60 the hard cakes are taken from the containers 50 and these cakes are pulverized in a conventional pulverizing mill as shown in FIG. 4 to approximately 25 mesh. As an example of proportions, 1200 grams of the pulverized silver bearing cake is placed in the bottom of a crucible and 600 grams by weight of sodium carbonate and 600 grams of boric acid powdered granules or beads, are mixed thoroughly and placed in a layer on top of the 1200 grams of pulverized silver bearing cake. The disclosure FIG. 6 illustrates the pulverized cake at 62, in the lower portion of a crucible 64, and the aforementioned flux is designated 66 and forms a cover for the pulverized cake material 62.

Figure 7:
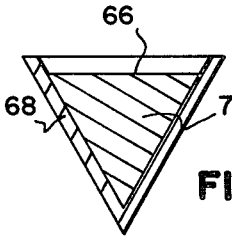
FIG. 7 is a sectional view of the first mold for the first metal casting according to the method.

Heat is then applied to the crucible 64 until the silver liquifies and is completely miscible and then the silver is poured into an inverted angle iron or other mold, such as the mold 68 shown in FIG. 7, and the flux 66 will lay on the top of the silver casting 70 and after the casting has cooled the flux layer 66 may be broken away.

The hereinbefore described flux has three important functions; one of which is that it produces a carbon dioxide atmosphere which is important. Another is that it acts as a liquid lid or cover on top of the pulverized sludge or cake to prevent oxidation of the silver and additionally it acts as a blotter to soak up any impurities that are in the cake.

The foregoing flux, including the sodium carbonate and the boric acid granules, provide a flux having a relatively low pH factor which does not cause rapid deterioration of the crucible 64. Accordingly the flux has a fourth important function in the present method.

Figure 8:
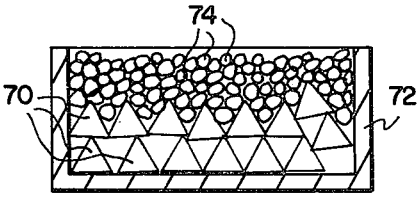
FIG. 8 is a sectional view of a second crucible in which the primary silver castings are remelted with charcoal on top.
Figure 9:
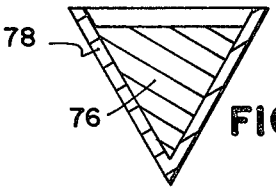
FIG. 9 is a cross section of a mold in which the final pure silver castings are poured.

After several of the castings 70 have been made, they may be placed in a second crucible 72 as shown in FIG. 8 and several charcoal briquettes 74 may be placed on top of the castings 70 in the crucible. When the castings 70 are melted in the crucible 72, the charcoal briquettes absorb the carbon dioxide gas; and after the silver has been completely melted and the charcoal briquettes are floating on top, they are then lifted off and as shown in FIG. 9, a secondary casting of silver designated 76 is poured into a final mold 78 wherein the silver 76 is of high purity.

It will be understood that the novel use of a precipitating and a flocculating agent in the settling tanks 36, and the placement of the silver sludge in the bags 40, provides for a very economical means by which the silver may be separated from the liquid, thereby obviating the need for complicated and expensive equipment such as a centrifuge, a vacuum filter press or a manual filter press and further obviating the use of high salaried employees. Accordingly the flocculating agent, functioning in the fabric bags, alleviates the need for such expensive equipment and high salaries and therefore economizes greatly relative to the process of the present invention.

It will be obvious to those skilled in the art that various modifications of the invention may be resorted to without departing from the spirit thereof.

I claim:

1. A method for reclaiming silver from photographic substrates; comprising: immersing and washing silver emulsion coated substrates in a dilute solution of sodium hypochlorite until the silver bearing emulsion is removed from said substrates and disposed in said solution; then introducing sodium hydroxide into said solution to precipitate said silver into a lower strata of said solution and introducing a flocculating agent into said solution and allowing said silver to settle to said lower strata in the form of sludge in said solution; then removing the diluted solution from an area above said lower strata; then placing the silver sludge from said lower strata into fabric bags wherein the flocculating agent tends to retain the silver sludge in the bags and allows the remainder of said solution to drain from the silver sludge until a substantial amount of moisture has escaped from the sludge and it is in a partially dried condition; and then placing the partially dried sludge in containers and thus subjecting it to a baking process until the sludge is in a dried cake condition.

2. The invention as defined in claim 1, wherein: the said sludge in dry cake condition is pulverized to a particulate condition; then placing the pulverized particulate material into a first crucible with a layer of flux on top and smelting the pulverized cake until the silver therein melts into the bottom of the crucible; then pouring the molten silver from the crucible to produce primary metal castings; and then removing the hardened flux from the top of said castings.

3. The invention as defined in claim 2, wherein: the primary castings are then refined by placing them in a second crucible with charcoal thereon; then melting the primary casting; and then removing the charcoal from the surface of the molten silver and pouring the molten silver in a mold to produce final silver castings of a high purity.

4. The invention as defined in claim 2, wherein: said baking process is carried on at approximately 600° Fahrenheit until smoke and fumes are released.

5. The invention as defined in claim 2, wherein: said flux comprises sodium carbonate and boric acid.

6. The invention as defined in claim 1, wherein: said bags are made of canvas like fabric material.

7. The invention as defined in claim 1, wherein: said hypochlorite is in a concentration substantially 14% solution, by weight, with water, to thereby form a bleach solution which is mixed with 10 parts of water to form said first mentioned water diluted solution of sodium hypochlorite.

8. The invention as defined in claim 1, wherein: said bags are made of No. 30 canvas duck material.

9. The invention as defined in claim 1, wherein: said silver is allowed to settle into a sludge for approximately 12 to 24 hours into said lower strata.

10. The invention as defined in claim 1, wherein: said film is introduced into a rotary washing machine and wherein said diluted solution of sodium hypochlorite is introduced into said rotary washing machine and then removed therefrom and retained in a tank, then rinse water is introduced into said rotary washing machine and then the rinse water is removed from the rotary washer and stored in a rinse water tank.

11. The invention as defined in claim 10, wherein: sludge and liquid from the lower part of the wash tank is transferred to settling tanks for precipitation and flocculation of silver into sludge in the settling tank.

12. The invention as defined in claim 11, wherein: liquid is removed from the upper strata of said settling tank leaving silver sludge in the bottom thereof, then said silver sludge is placed in canvas bags and said canvas bags are hung such that the liquid drains from the canvas bags leaving the sludge in the form of a semi-dried mud like material, then taking said sludge in its mud like form and placing it in containers and subjecting it to sufficient heating to dry it into relatively hard cake like form.

13. A method for reclaiming silver from pliable photographic substrates comprising: immersing and tumbling pliable silver emulsion coated substrates in a dilute solution of sodium hypochlorite until the silver bearing emulsion is removed from the substrates in said solution; then introducing sodium hydroxide into said solution to precipitate said silver into a lower strata of said solution and introducing a flocculating agent into said solution and allowing said silver to settle to said lower strata in the form of sludge in said solution; then removing the diluted solution from an area above said lower strata; then placing the silver sludge from said lower strata into fabric bags wherein the flocculating agent tends to retain the silver sludge in the bags and allows the remainder of said solution to drain from the silver sludge until a substantial amount of the moisture has escaped from the sludge and it is in a partially dried condition, thereby leaving it in a substantially mud like consistency; and then placing the partially dried sludge in containers and subjecting said partially dried sludge to a baking process at approximately 600° Fahrenheit until the sludge is in a substantially dry cake condition.

14. The invention as defined in claim 13, wherein: said substrate is a pliable plastic film and wherein the film is first tumbled to separate the individual sheets of film whereupon the aqueous solution of sodium hypochlorite is then introduced into contact with the film.

* * * * *